US012473693B2

(12) United States Patent
Rissanen et al.

(10) Patent No.: US 12,473,693 B2
(45) Date of Patent: Nov. 18, 2025

(54) BCTMP-TAILORED SCK PAPER FOR RELEASE LINER

(71) Applicant: UPM-Kymmene Corporation, Helsinki (FI)

(72) Inventors: Mikko Rissanen, Helsinki (FI); Jukka Kotilainen, Helsinki (FI); Harri Hiltunen, Helsinki (FI); Kaarina Kekäläinen, Helsinki (FI); Jari Heikkinen, Helsinki (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 334 days.

(21) Appl. No.: 18/113,743

(22) Filed: Feb. 24, 2023

(65) Prior Publication Data

US 2024/0287741 A1 Aug. 29, 2024

(51) Int. Cl.

| | |
|---|---|
| ***D21H 27/00*** | (2006.01) |
| ***D21H 11/02*** | (2006.01) |
| ***D21H 11/04*** | (2006.01) |
| ***D21H 11/20*** | (2006.01) |

(52) U.S. Cl.
CPC ..... *D21H 27/001* (2013.01); *D21H 11/02* (2013.01); *D21H 11/04* (2013.01); *D21H 11/20* (2013.01)

(58) Field of Classification Search
CPC ..... D21H 27/001; D21H 11/02
See application file for complete search history.

(56) References Cited

U.S. PATENT DOCUMENTS

| | | | |
|---|---|---|---|
| 5,316,621 | A | 5/1994 | Kitao et al. |
| 2005/0126729 | A1 | 6/2005 | Koskinen et al. |
| 2007/0082212 | A1 | 4/2007 | Corrigan et al. |

(Continued)

FOREIGN PATENT DOCUMENTS

| | | | |
|---|---|---|---|
| EP | 3059344 | A1 | 8/2016 |
| EP | 3059344 | B1 | 12/2017 |

(Continued)

OTHER PUBLICATIONS

European Application No. 24185175.7, "A BCTMP-tailored low basis weight glassine paper for release liner"; 62 pages.

(Continued)

*Primary Examiner* — Anthony Calandra
(74) *Attorney, Agent, or Firm* — CANTOR COLBURN LLP

(57) ABSTRACT

The invention relates to a method for manufacturing SCK paper having a basis weight in the range of 50 to 70 g/m$^2$, wherein an optimal combination of BSKP and BCTMP is used to adjust the properties of the fiber furnish. In SCK papers with low basis weight the bulk of the formed paper web upon paper manufacturing may be controlled by means of the fiber furnish, without downgauging and without adverse effects to other paper properties, which would prevent the use of the SCK paper as substrate layer in a release liner. Thus SCK paper with exceptionally high share of BCTMP in the fiber furnish may be produced into the same thickness as was possible before for a conventional supercalendered kraft paper having a higher basis weight, while maintaining other quality characteristics of the paper sufficient for use as a substrate layer of an industrial release liner.

16 Claims, 3 Drawing Sheets

(56) References Cited

U.S. PATENT DOCUMENTS

| | | | |
|---|---|---|---|
| 2009/0104431 | A1 | 4/2009 | Kishida et al. |
| 2010/0203318 | A1 | 8/2010 | Galembeck et al. |
| 2017/0190799 | A1 | 7/2017 | Rissanen et al. |
| 2018/0298556 | A1 | 10/2018 | Xu et al. |
| 2020/0173109 | A1 | 6/2020 | Saukkonen et al. |
| 2021/0340708 | A1 | 11/2021 | Kosonen et al. |
| 2024/0218295 | A1 | 7/2024 | Thompson et al. |
| 2025/0092604 | A1 | 3/2025 | Kotilainen et al. |

FOREIGN PATENT DOCUMENTS

| | | | | |
|---|---|---|---|---|
| EP | 3805453 | A1 | 4/2021 | |
| EP | 3870755 | A1 | 9/2021 | |
| EP | 4074892 | A1 | 10/2022 | |
| EP | 4310249 | A1 * | 1/2024 | ..... D21H 27/10 |
| JP | 04209881 | | 7/1992 | |
| JP | H04209881 | A | 7/1992 | |
| JP | H05209383 | A | 8/1993 | |
| JP | 07109699 | | 4/1995 | |
| JP | H07109699 | A | 4/1995 | |
| JP | H07216321 | A | 8/1995 | |
| JP | 2007186816 | A | 7/2007 | |
| WO | WO-0159212 | A1 * | 8/2001 | ..... D21H 11/10 |
| WO | 2020084188 | A1 | 4/2020 | |
| WO | 2021255326 | A1 | 12/2021 | |
| WO | 2022086456 | A1 | 4/2022 | |
| WO | 2024099607 | A1 | 5/2024 | |

OTHER PUBLICATIONS

U.S. Appl. No. 18/757,680; "BCTMP-Tailored Low Basis Weight SCK Paper for Release Liner", 52 pages.

European Search Report for European Patent Application No. 24185175.7 dated Dec. 5, 2024.

International Search Report and Written Opinion for International Application No. PCT/FI2023/050724; International Filing Date Dec. 21, 2023; Report Mail Date Mar. 22, 2024 (16 Pages).

International Search Report and Written Opinion for International Application No. PCT/EP2023/075765; International Filing Date Sep. 19, 2023; Report Mail Date Jan. 3, 2024 (11 Pages).

International Search Report and Written Opinion for International Application No. PCT/FI2023/050725; International Filing Date Dec. 21, 2023; Report Mail Date Mar. 22, 2024 (14 Pages).

* cited by examiner

BCTMP-TAILORED SCK PAPER FOR RELEASE LINER

FIELD OF THE INVENTION

The invention relates to a supercalendered kraft paper suitable for use as a substrate layer of an industrial release liner for adhesive labels having a basis weight in the range of 50-70 g/m$^2$, which contains bleached kraft pulp and bleached chemithermomechanical pulp. The invention further relates to a method for manufacturing such supercalendered kraft paper and to a release liner, which contains such supercalendered kraft paper.

BACKGROUND

The packaging industry is booming and adhesive labels are in high demand. As a result of this, the label industry is trying to increase the speed of the existing labelling processes, to meet this demand. This resonates to the supply chain, all the way down to the global pulp production. Release liner plays a significant role in the production and exploitation of adhesive labels. Hence, there is a need for improved ways of producing papers suitable for release liners, which is challenging, however, due to the high quality and functionality expected from these paper types.

A release liner refers to a product comprising a substrate layer and a release coating, such as a silicon polymer based compound, applied on at least one side of the substrate layer. Release liners are widely used as backing materials in labelling applications with adhesive labels, which explains the expectation of high quality. The substrate layer should have sufficient characteristics to withstand the stresses applied at today's high-speed automated labelling processes. The substrate layer typically comprises a paper and a primer coating applied on at least one side of the paper. Examples of paper types suitable for use as release liner substrate layers are glassine paper, supercalendered kraft paper and clay coated paper. Conventionally, to meet the quality expectations, highly refined bleached chemical pulp, such as bleached kraft pulp, hereafter denoted as BKP, is used for manufacturing a paper suitable for use as a substrate layer of an industrial release liner. The amount of hardwood in the pulp mixture is typically high, in order to obtain a good formation and a paper having sufficient incompressibility, smoothness and dense structure. Prior to release coating the paper is also calendered, to increase the transparency and to provide a dense and smooth surface and a desired target thickness which meets the tolerance level set by the die-cutting system. Label producers use a release liner as a substrate for producing a face stock, from which the adhesive labels are cut. Minimal variation of release liner thickness is desired, to facilitate an even die strike pattern at a depth needed for the intended application. Different depth of impression left by the blades is used for different applications. High level of transparency is needed from the paper, since optical sensors are widely used for tracking the position of the labels on the release liner. Typically the optical sensors measure the brightness variation of a light beam, such as an infrared light beam, which is transmitted through a release liner.

In theory, one option for the paper manufacturer to alleviate the shortage of raw material could be to simply reduce the basis weight of the paper upon manufacturing, whereby less amount of pulp would be consumed. The basis weight, as used herein, refers to the grammage of the paper, in grams per square meter. To preserve the quality characteristics, however, the loss of fiber furnish would require compensation by calendering the paper more, which would lead into downgauging, that is, reduction of the paper thickness. A thinner paper having less basis weight would be a different product, in many aspects. A different die strike depth would likely be needed, for the die-cutting system. The paper product would no longer have the same properties as earlier, either, and the risk of inducing adverse effects downstream, when the paper is part of a release liner, is increased. The mechanical properties of the paper, such as surface smoothness, surface density and tearing resistance, may suffer to an extent that a release liner manufactured from such paper would not function properly, when exposed to the conditions present in a labelling process. This is of particular concern with papers having a low basis weight to start with, typically in the range of 50-70 g/m$^2$, wherein the relative tolerance levels set by the label converter due to the die-cutting systems are stricter. Glassine paper is an example of a product type from which superior runnability and almost standardized target values are demanded, throughout the whole value chain.

Bleached chemithermomechanical pulp, denoted as BCTMP, offers a way to increase the bulk of the paper and to maintain the ratio between the basis weight and the thickness within a desired range. While this may reduce the basis weight, the risk remains that the produced paper does not meet the label converter's expectations in respect of other quality characteristics, when considering use as a substrate layer of an industrial release liner. BCTMP is high yield pulp manufactured by a hybrid process, wherein wood chips are first pre-treated with chemicals, heated for a short period and subsequently refined by mechanical means. This produces pulp having a yield typically in the range of 80 to 95 wt. %, wherein compounds other than cellulose present in the wood material have been preserved to a large extent. The properties of BCTMP thus differ from the properties of bleached chemical pulp, such as BKP. Controlling the density of the paper together with other quality characteristics at a higher production speed on a paper machine becomes more complex, when BCTMP is added. The addition of BCTMP affects the mechanical and optical properties of the produced paper, such as transparency. The flaws of a produced paper, when considering suitability for release liner applications, may not become evident until the paper has already been manufactured and even siliconized, which would make the recycling of the product more difficult, as well.

SUMMARY

The invention solves the challenges disclosed above by providing a method for manufacturing supercalendered kraft paper having a basis weight in the range of 50 to 70 g/m$^2$, wherein an optimal combination of bleached softwood kraft pulp and BCTMP is used to adjust the properties of the fiber furnish. The production of supercalendered kraft papers with low basis weight allows to maintain the relative shares of the bleached softwood kraft pulp and BCTMP in defined ranges, such that the bulk of the formed paper web upon paper manufacturing may be controlled without downgauging and without adverse effects to other paper properties which would prevent its use as substrate layer of an industrial release liner for adhesive labels. In other words, by controlling the amount of bleached softwood kraft pulp and BCTMP a bulky kraft paper may be produced, wherein the fiber furnish enables supercalendering of the paper to typical target thickness used for corresponding supercalendered kraft paper grade having a higher basis weight, which therefore has a higher density. Thus a supercalendered kraft paper with exceptionally high share of BCTMP in the fiber furnish may be produced into a thickness range typical for higher basis weight products, while maintaining other quality characteristics of the paper sufficient for use as a substrate layer of an industrial release liner.

Supercalendered kraft paper, hereafter referred to as SCK paper, is a distinguished type of paper that is used as a release liner substrate due to its outstanding characteristics. As disclosed above, SCK paper is typically produced of highly refined bleached chemical pulps from a kraft process. Bleached hardwood kraft pulp is hereafter abbreviated as BHKP. Bleached softwood kraft pulp is hereafter abbreviated as BSKP. The chemical cooking preserves the characteristics of the fibers in the pulp better in comparison to mechanical pulping methods, whereby the chemically pulped fibers may be better used for providing strength to the produced paper. Bleaching, in turn, removes residual lignin still present after the chemical cooking operation, which increases the pulp whiteness and brightness. The whiteness of SCK is obtained without external dyes or colorants. A SCK paper typically contains a fiber furnish that includes both BSKP as well as BHKP. Different wood species produce different type of fibers, hence the origin of the pulp, in addition to the pulping method, may be used for adjusting the characteristics of the produced paper. For instance, BHKP in general is advantageous, in comparison to BCTMP, for the brightness and transparency of the product. The specifications of the produced paper may thus be altered by means of adjusting the share of pulp in a fiber furnish. The challenge, as indicated above, is that when the amount of a given pulp component is adjusted, it typically has an effect to several other paper characteristics. Thus, the dilemma lies in the multivariable optimization—how to improve desired paper characteristics without deteriorating others to the extent that the paper no longer meets the set quality specifications for the intended purpose.

SCK paper is manufactured on a paper machine by forming a paper web from selected pulp types which have been mixed together, such that a pulp mixture has been obtained. Automated optical analysis using unpolarized light may be used for determining the properties and fiber furnish of the pulp mixture, whereby for example fibers produced by chemical or mechanical pulping methods and their dimensions may be identified. The moisture content of the paper web is reduced in a press section, after which the paper web is dried in a drying section, whereby paper is formed. The ultimate properties of SCK paper manufactured at a paper machine, such as transparency and target thickness, are obtained by supercalendering, which is performed using a line pressure, heat and moisture content that are higher than conventionally used during an ordinary calendering treatment. Supercalendering enables to produce kraft paper having high density surface and high transparency.

However, the level of compression used in calendering is less than is typically used for glassine paper, whereby the surface roughness is higher and the fiber structures of SCK paper are less damaged during the calendering. While SCK paper still displays excellent strength properties and relatively high transparency, it can be produced into technical specification ranges that are broader than allowed for glassine paper. Thus, SCK paper is not glassine paper. Moreover, the whiteness and brightness of SCK paper is due to the bleaching of the fibers, without added dyes or optical brightening agents, which also distinguishes it from glassine papers, which may be dyed. The method for manufacturing SCK paper is thus more pliable for changes, also in respect of fiber furnish compositions.

Considering the characteristics of highly refined BKP, the replacement of such BKP in a fiber furnish with BCTMP is not straightforward, should the mechanical and optical properties of the produced paper be maintained. As disclosed above, the manufacturing method of BCTMP differs from BKP. The two pulp types thus differ in many aspects. This can be seen in the mass of the particles in fiber length fractions in BCTMP, for instance. The distribution of the mass of the particles in fiber length fractions differs considerably from those in BHKP. It also differs significantly from the mass of the particles in fiber length fractions in BSKP. When considering the characteristics of BCTMP, the mass of the particles in shorter fiber length fractions, up to 1.2 mm in length, forms majority of the total mass, while in BSKP, the opposite seems to be the case. In BSKP, mass of the particles in longer fiber length fractions having a length equal to or higher than 1.2. mm appears to be dominant, when determined with Valmet Fiber Image Analyzer (Valmet FS5), implementing ISO 16065-2: 2014, ISO 9184-4 and ISO 9184-1. This can also be seen in fiber length distribution of the BCTMP that differs considerably from fiber length distribution of the BHKP and particularly of the fiber length distribution of the BSKP. The gist thus lies in understanding how the underlying properties of the different type of pulps may be optimally used together in SCK paper to reduce the basis weight while preserving the thickness, in a way which prevents other relevant quality characteristics from falling out of specifications.

Experimental studies indicate that SCK paper having a low basis weight is exceptionally suitable for the adjustment of density with BCTMP. The results further indicate that SCK paper having a basis weight in the range of 50-70 g/m$^2$, and wherein the amount of BSKP is equal to or higher than 15 wt. % (SCAN P 39:80), enables very effective basis weight reduction, when BCTMP is used in an amount equal to or higher than 5 wt. % to replace BHKP. Uncalendered paper sheets, which contained BCTMP in the range of 5 to 50 wt. %, when determined as dry matter content of the paper, demonstrated a considerable increase of bulk. The uncalendered paper sheets, when exposed to conditions corresponding to industrial supercalendering, could also be calendered into the same thickness as corresponding industrial SCK papers, which contain only BHKP and BSKP. When the content of BCTMP was increased from 5 to 50 wt. %, the observed effect of BCTMP into the thickness of SCK paper was 4% in SCK paper having a basis weight of 58 g/m$^2$, 6% in SCK paper having a basis weight of 62 g/m$^2$, and 11% in SCK paper having a basis weight of 68 g/m$^2$. The combination thus enables to reduce the basis weight of the SCK paper, without downgauging.

The bulk increase obtainable when replacing BHKP with BCTMP is particularly interesting in SCK paper grades having a basis weight in the range of 50-70 g/m$^2$, and a density in the range of 1040 to 1140 kg/m$^3$, wherein the bulk may be flexibly controlled with the share of BCTMP in the fiber furnish, while using the share of BSKP to adjust other paper characteristics, such as tear strength of the paper. Further, the substitution of BHKP with BCTMP enables to maintain or even increase bending stiffness of the SCK paper, whereby a good potential to resist compression, which facilitates an even die strike pattern during a die-cutting operation, is obtainable. Advantageously, the SCK paper has a density in the range of 1040 to 1120 kg/m$^3$, preferably in the range of 1040 to 1100 kg/m$^3$, most preferably in the range of 1040 to 1080 kg/m$^3$. On this density range, the reduction in basis weight with BCTMP has been observed to have a particular cost advantage. Experimental results indicate that SCK paper containing a combination of BCTMP and BSKP, as disclosed above, still possesses a tear index higher than 5 $mNm^2/g$ (ISO 1974), which is sufficiently high for use as a substrate layer of an industrial release liner for adhesive labels. The tear index in the cross direction of the paper is particularly advantageous, considering the use as a substrate layer in labelling processes. The fiber furnish composition in the basis weight in the range of 50-70 $g/m^2$ also facilitates to maintain a sufficient transparency of the supercalendered kraft paper. Experimental results from SCK paper specimens having said basis weight range of 50-70 $g/m^2$ indicate that a fiber furnish containing BCTMP in the range of 5 to 50 wt. %, when determined as dry matter content of the paper, may be supercalendered into a target thickness corresponding to similar kraft papers without BCTMP, while maintaining a transparency level of at least 40%, such as in the range of 40 to 56%.

Hence, according to a first aspect and as indicated above, there is provided a supercalendered kraft paper suitable for use as a substrate layer of an industrial release liner for adhesive labels, the supercalendered kraft paper comprising

- a basis weight in the range of 50 to 70 $g/m^2$, when determined by standard ISO 536, and
- a fiber furnish determinable with standard ISO 9184-4 in conjunction with standard ISO 9184-1, the fiber furnish comprising
  - bleached hardwood kraft pulp,
  - bleached softwood kraft pulp and
  - bleached chemithermomechanical pulp, such that the supercalendered kraft paper contains

- the bleached chemithermomechanical pulp in an amount equal to or higher than 5 wt. % and the bleached softwood kraft pulp in an amount equal to or higher than 15 wt. %, when determined as dry matter content of the paper according to SCAN-P 39:80, the supercalendered kraft paper thereby having

- a transparency level equal to or higher than 40%, determinable by using the standard ISO 2469 and
- a density in the range of 1040 to 1140 $kg/m^3$, determinable by using the standard ISO 534.

Further, according to a second aspect and as indicated above, there is provided a method of manufacturing supercalendered kraft paper suitable for use as a substrate layer of an industrial release liner for adhesive labels, the method comprising

- mixing together
  - bleached hardwood kraft pulp,
  - bleached softwood kraft pulp, and
  - bleached chemithermomechanical pulp,
- such that a pulp mixture is obtained, which has a fiber furnish determinable with standard ISO 9184-4 in conjunction with the standard ISO 9184-1,
- forming a paper web from the pulp mixture on a paper machine,
- reducing moisture content of the paper web in a press section,
- drying the paper web in a drying section, thereby forming paper, and
- calendering the paper,
- such that a supercalendered kraft paper is obtained having a basis weight in the range of 50 to 70 $g/m^2$, and which contains the bleached chemithermomechanical pulp in an amount equal to or higher than 5 wt. % and the bleached softwood kraft pulp in an amount equal to or higher than 15 wt. %, when determined as dry matter content of the paper according to SCAN P 39:80, the supercalendered kraft paper thereby having

- a transparency level equal to or higher than 40%, determinable by using the standard ISO 2469 and
- a density in the range of 1040 to 1140 $kg/m^3$, determinable by using the standard ISO 534.

Further still, there is provided a release liner comprising a substrate layer and a release coating, wherein the substrate layer is a supercalendered kraft paper as indicated above, which comprises a primer coating applied on at least one side of the supercalendered kraft paper. The primer coating is typically a surface sizing applied in the range of 1 to 5 $g/m^2$ per side. The prime coating typically contains water-soluble polymers, such as starch, polyvinyl alcohol and/or carboxymethyl cellulose, which are compatible with addition-curing silicone systems used in release coatings.

Typically, the BCTMP comprises fibers from hardwood, the hardwood being a broadleaved tree, such as aspen, birch, maple or *eucalyptus*. Maple belongs to the genus Acer. Birch belongs to the genus *Betula*. *Eucalyptus* belongs to the genus *Eucalyptus*, comprising species such as *Eucalyptus globulus*. Aspen belongs to the genus *Populus*, comprising species such as *Populus tremuloides* and *Populus tremula*. Aspen is considered advantageous due to low yellowing of the fibers. Aspen fibers have a large specific surface that scatter light, which increases the brightness of a paper, but may reduce transparency. BCTMP from hardwood is advantageous for increasing the bulk of the fiber furnish. Advantageously, however, the BCTMP comprises fibers from softwood, the softwood being a coniferous tree, preferably from the genus *Picea, Abies, Larix* or *Pinus*, most preferably from *Picea*, such as *Picea abies* or *Pinus*, such as *Pinus strobus, Pinus palustris, Pinus lambertiana, Pinus taeda, Pinus monticola* or *Pinus poderosa*. BCTMP from softwood may be used for increasing the transparency of the fiber furnish. Advantageously, a BCTMP mixture comprising fibers from hardwood and softwood may be used to provide a pulp with balanced properties. A BCTMP mixture comprising fibers from hardwood and softwood may in particular be used to improve the manufacturing process conditions, upon producing the SCK paper. Advantageously, the share of softwood fibers in the BCTMP is in the range 10 to 60 wt. %, preferably in the range 15 to 50 wt. %, most preferably in the range of 20 to 40 wt. %, when determined as dry matter content of the BCTMP according to SCAN-P 39:80.

The properties of BCTMP may also be used to adjust other aspects of the fiber furnish, such as in the water retention capability of the fibers. Water retention value, abbreviated as WRV, is an empirical measure of the capacity of a pulp sample to hold water, determinable according to ISO 23714:2014(en). BCTMP made of hardwood such as aspen typically comprises a low water retention capability. The increase of the share of BCTMP in the pulp mixture, upon manufacturing SCK paper for a release liner, may be used to reduce the capacity of the pulp mixture to hold water. Thus, by adjusting the fiber furnish of the SCK paper with BCTMP, a WRV equal to or higher than 1.58 g/g, preferably equal to or higher than 1.60 g/g, most preferably equal to or higher than 1.84 g/g, may be obtained. A fiber furnish containing BCTMP in the range of 5 to 50 wt. % may be used to provide a pulp composition having WRV, which is in the range of 1.50 to 1.90 g/g, preferably in the range of 1.54 to 1.88 g/g, most preferably in the range of 1.58 to 1.84 g/g, from a sample having a dry matter content of 1 gram (ISO 23714:2014).

Advantageously, the characteristics of the BCTMP are also adjusted by refining, such that upon mixing, the bleached chemithermomechanical pulp has a Schopper-Riegler number, denoted as °SR, equal to or less than 60, such as in a range from 25 to 55, preferably in the range of 30 to 55, most preferably in the range of 40 to 50, when determined according to ISO 5267-1. Refining is a mill operation wherein the pulp fibers are subjected to high shear forces. This reduces the average fiber length of the pulp fibers, but also modifies the pulp fibers physically, for example by fibrillation, such that the fiber structures become looser. The Schopper-Riegler test measures the drainability of a pulp suspension in water. Advantageously, the SCK paper has a fiber furnish, which has an average length weighted fiber length equal to or higher than 0.98 mm, preferably equal to or higher than 1.06 mm, most preferably equal to or higher than 1.11 mm, such as in the range of 0.90 to 1.14 mm, preferably in the range of 0.95 to 1.12 mm, most preferably in the range of 0.98 to 1.11 mm, when determined according to ISO 16065-2: 2014. Refining of the pulp thus causes multiple effects downstream on the SCK paper manufacturing process. It produces shorter fibers which may be packed together closer, which enables to manufacture SCK paper having higher surface smoothness and surface density. However, refining also increases the moisture uptake of the pulp, which increases the amount of water to be removed from the formed paper web, in the press section and the drying section of a paper machine, which may cause dimensional changes and shrinkage of the SCK paper, and may also be seen in the paper quality, such as paper strength.

The manufacturing method of BCTMP also produces fibers, which in general differ from those obtained from kraft process. Hence, the amount of BCTMP in the fiber furnish also adjusts the average fiber width. Advantageously, the SCK paper has a fiber furnish, wherein the fiber furnish has an average fiber width of equal to or less than 25 micrometers, preferably in the range of 22 to 25 micrometers, most preferably in the range of 23 to 25 micrometers, when determined according to ISO 16065-2: 2014.

Advantageously, the SCK paper contains the BCTMP in an amount in the range of 5 to 50 wt. %, when determined as dry matter content of the paper according to SCAN-P 39:80. The share of BCTMP in the fiber furnish has an effect to the bulk of the uncalendered kraft paper, as well as to the bending stiffness of the supercalendered kraft paper. However, a higher BCTMP share also increases the roughness variation of SCK paper, whereby a BCTMP content in the range of 25 to 45 wt. % may be optimal, when paper smoothness is desired, in addition to bulk. When considering also the transparency of the SCK paper, a SCK paper which contains the BCTMP in an amount in the range of most preferably in the range of 30 to 40 wt. %, when determined as dry matter content of the paper according to SCAN-P 39:80, is preferred. The transparency of SCK paper, in general, is lower in paper grades, wherein the BCTMP content is higher. However, experimental results indicate that a SCK paper having a basis weight of 68 g/m$^2$, a density of 1105 kg/m$^3$ and which contains 15 wt. % of BSKP and 50 wt. % of BCTMP, determined as dry matter content of the paper according to SCAN-P 39:80, may have a transparency of 48%, which is sufficient for measuring brightness variation through a release liner by means of optical sensors and a light beam, such as an infrared light beam. The optimal combination of BSKP and BCTMP thus enables a production of SCK paper wherein the optical quality is maintained sufficiently such that the paper is suitable for use as a substrate layer of a release liner. Advantageously, the SCK paper has a transparency equal to or higher than 42%, preferably equal to or higher than 44%, such as in the range of 42 to 54% or in the range of 44 to 52%, determinable by standard ISO 2469.

Experimental studies further indicate that BSKP present in the fiber furnish of the SCK paper is highly advantageous for compensating the effects caused by the loss of average fiber length, due to BCTMP used to replace BHKP, as indicated above. The results indicate that when the SCK paper contains BSKP in an amount equal to or higher than 20 wt. %, when determined as dry matter content of the paper according to SCAN-P 39:80, an average length weighted fiber length equal to or higher than 1.03 mm is obtainable. When the SCK paper contains the BSKP in an amount equal to or higher than 30 wt. %, an average length weighted fiber length equal to or higher than 1.10 mm is obtainable. Advantageously, the SCK paper contains the BSKP in the range of 15 to 65 wt. %, preferably in the range of 20 to 60 wt. %, most preferably in the range of 30 to 55 wt. %.

Most advantageously, the SCK paper as disclosed above has a fiber furnish comprising BHKP in an amount equal to or less than 35 wt. %, BSKP in an amount equal to or higher than 15 wt. % and BCTMP in an amount equal to or higher than 35 wt. %, when determined as dry matter content of the paper according to SCAN P 39:80, such that the SCK paper has CIE L*, a*, b* colour space coordinate values, wherein L* is in the range of 92 to 98, a* is in the range of −4 to +2, and b* is in the range of +5 to +11, the values measured by means of diffuse reflectance method with the elimination of specular gloss, using 2° standard observer, in accordance with ISO 5631-1:2015(en).

Objects and embodiments of the invention are further described in the independent and dependent claims.

DETAILED DESCRIPTION

Figure 1:
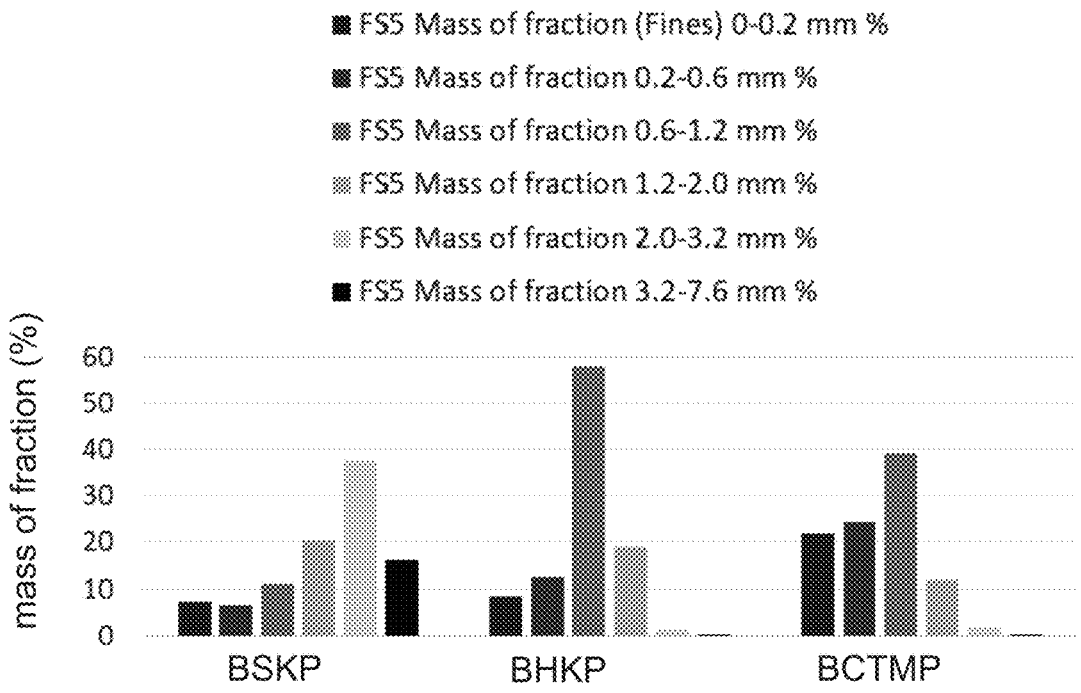
FIG. 1 is a diagram showing comparative data of the difference in average mass of fractions (relative share, %) between BCTMP, BHKP and BSKP, when determined with Valmet Fiber Image Analyzer (Valmet FS5), according to the manufacturer's instructions.

A Method for Manufacturing SCK Paper on a Paper Machine

SCK paper comprising BCTMP is manufactured on a paper machine from a pulp mixture comprising bleached chemical pulp from a kraft process. Typically, a pulp mixture for SCK paper comprises BSKP and BHKP. BCTMP may be used when the bulk of the formed paper is to be increased. The mixing of the pulps may be performed, for example by homogenising pulp mixture in a mixer. The amount of BCTMP in the pulp mixture may be varied in the range of 5 to 50 wt. %, when determined as dry matter content of the paper (SCAN P 39:80). BHKP, on the other hand, is advantageous for the brightness and transparency of the product. BSKP has a longer average fiber length than BHKP or BCTMP, and is therefore advantageous for the strength properties of the formed paper web. Typically, the pulps are refined, at a refining section of a paper machine prior to forming the pulp mixture. The pulps may be refined separately, where necessary.

A paper web for SCK is formed from the pulp mixture at a forming section of the paper machine. Typically, at a headbox of a paper machine, a pulp suspension having a concistency between 0.25 and 1 wt. % is used.

A weight percentage, abbreviated as wt. %, is used to describe a weight fraction of component in a composition. A weight percentage of pulp is used to describe a weight fraction of a pulp in a material. A weight percentage of pulp in a paper denotes the dry weight of the pulp in a dry paper, when determined according to SCANP-39:80 test method for dry matter content. The dry weight of a sample is determined by weighing 20 grams of sample on a dish before and after oven drying at 105° C. and eliminating the mass of the empty dish from the measurement. Oven dry pulp has been dried at 105° C. until its mass is constant and cooled thereafter in an exicator to ambient temperature of 25° C., prior to weighing.

The formed paper web is forced against the forming wire, to remove water, denoted as dewatering. Part of the fine particles present in the pulp suspension may flow through the wire, and are recycled back to the headbox via the short circulation. The amount of recycled fine particles defines a retention level, which describes the ability of the formed paper web to retain the fine particles on the web, and therefore the balance between drainage and formation of the paper web. The content of fine particles may be varied, for example, by selecting the pulp types and their relative shares in the pulp mixture, the wood species used for producing the pulps and by the extent of refining. An optimum retention level of the initially forming paper web enables drainage of water from the paper web such that the moisture content of the paper web may be controlled in the subsequent press and drying sections of the paper machine. The press section comprises a number of rolls for guiding and/or pressing the paper web. In the drying section, the paper web is heated to evaporate most of the remaining moisture in the paper web, thereby forming paper. After drying section, the formed paper typically has a dry content level equal to or more than 90 wt. %, for example in the range of 90 to 95 wt. %.

The finishing of the formed paper is done by surface sizing and calendering treatment. The ultimate properties of SCK paper, such as transparency and target thickness, are obtained by supercalendering, which is performed using a line pressure, heat and moisture content that are higher than conventionally used during an ordinary calendering treatment. The supercalendering of kraft paper is typically performed in a temperature in the range of 100 to 200° C. The line pressure used for supercalendering a kraft paper is generally in the range of 300 to 500 KN/m. Prior to supercalendering, the moisture content of the kraft paper may be elevated, for example by subjecting it to a spray of water or steam, such that upon supercalendering, the kraft paper has a dry content level less than 90 wt. %, such as in the range of 75 to 90 wt. %. Supercalendering enables to produce kraft paper having high density surface and high transparency. The surface of the supercalendered kraft paper is typically sized with a water-soluble polymer or a mixture of polymers in an amount ranging from 1 to 5 g/m$^2$. Examples polymers used for surface sizing are water-soluble polyvinyl alcohol, starch and carboxymethyl cellulose. The surface sizing may be used for improving the surface denseness and to enhance the barrier properties. The surface sizing may further be used for optimizing the compatibility of the surface to a subsequent release coating.

The composition of the pulp mixture upon manufacturing SCK paper may thus be used for adjusting the properties of the fiber furnish, thereby enabling formation of a paper, which may be further treated by supercalendering such that predefined properties, such as sufficient transparency and target thickness are achieved.

BCTMP for SCK Paper

The characteristics of the BCTMP for the SCK paper production may be evaluated, for instance, based on the bulk, brightness, pH and drainability of the pulp. Advantageously the bulk of the BCTMP is equal to or higher than 1.8 cm$^3$/g, preferably at least 2.0 cm$^3$/g, such as in the range of 1.8 to 3.2 cm$^3$/g, when determined according to ISO 534. Advantageously the brightness of the BCTMP is equal to or higher than 60%, preferably equal to or higher than 80%, such as in the range of 60 to 85%, when determined according to ISO 2470.

BCTMP for SCK paper, as disclosed herein, may be manufactured by a hybrid process wherein wood chips are first pretreated with chemicals, heated for a short period and subsequently refined by mechanical means. When the wood chips are pretreated in a higher pH, preferably by impregnating the wood chips with chemicals, the internal bonding of the fibers may be reduced, such that the specific volume of the formed chemithermomechanical pulp may be increased. The pH during the chemical impregnation treatment is typically above 7 and thus the treatment is alkaline. The pH environment experienced by the wood chips may be, for example in the range of pH 7 to 11, advantageously in the range of pH 7 to 9. By increasing the pH of the chemical impregnation treatment, the duration of the chemical impregnation treatment and the duration of the subsequent heating, preferably by steam, the bulkiness of the formed chemithermomechanical pulp may be increased such that less amount of refining may be required for providing the desired water retention value and fiber length distribution. When high intensity refining is used upon producing BCTMP, less energy is needed for the fibrillation of the fibers. Thus, the amount of short fibers, such as fine particles, in the BCTMP may be increased, which increases the bulk. These short fibers are beneficial for reducing the basis weight of a paper.

BCTMP comprising fibers from both hardwood and softwood may have a higher pH value than BCTMP comprising fibers from only hardwood. The presence of fibers from softwood may also be arranged to protect the hardwood fibers during mechanical refining of the BCTMP. For example, a BCTMP mixture of both aspen and spruce has been noticed to refine less than when the components are refined separately in the same conditions. The manufacturing process of BCTMP may also be improved by adjusting the pH and extent of refining, such that BCTMP having a desired water retention value and fiber length distribution is obtained.

In addition to the Schopper-Riegler test disclosed above, Canadian Standard Freeness (hereafter denoted as CSF) may be used to determine the drainability of a pulp suspension, in units of millilitres (ml). Preferably, upon mixing, the bleached chemithermomechanical pulp advantageously has a Canadian Standard Freeness (hereafter denoted as CSF) value of equal to or more than of 90 ml, such as in the range of 90 to 500 ml and the pH of aqueous extracts equal to or above pH 7.0, preferably a CSF value equal to or more than 130 ml, such as in the range of 130 to 425 ml and the pH of aqueous extracts equal to or above pH 7.1, most preferably a CSF value equal to or more than 325 ml, such as in the range of 325 to 435 ml and the pH of aqueous extracts equal to or above pH 7.3. The Canadian Standard Freeness value may be determined in accordance with ISO 5267-2:2001. The pH of the pulp may be determined from aqueous pulp extracts according to ISO 6588-2 (2020). The pulp pH is measured from an aqueous extract having a temperature in the range of 20 to 25° C., by means of a pH meter, using two buffer solutions having pH 4 and pH 7, respectively. Suitable pH meters are, for example, pH-meter CG 840 with electrode N 1042A, Knick pH-meter 766 Calimatic with electrode SE 103 or Mettler-Toledo MP 120, used according to the manufacturer's instructions.

Experimental Studies

Reference is made to FIGS. 1-6. Experimental studies were carried out to characterize BCTMP, BSKP and BHKP and to assess the significance of the relative share of these pulps in a fiber furnish of SCK paper having a basis weight in the range of 50-70 g/m$^2$. Of particular interest was the dependency of the relevant quality characteristics of the SCK paper on the relative share of these pulps. A specific aim was to investigate how the BCTMP content adjustment of the fiber furnish composition of SCK papers having a low basis weight would affect the density in selected target thicknesses and which type of adjustments would least interfere with SCK paper quality characteristics that would prevent the use of the SCK paper as substrate layer of an industrial release liner for adhesive labels.

Experimental Setup

An experimental setup was thus designed wherein the relationship between BCTMP, BSKP and BHKP in fiber furnishes of SCK papers having a basis weight in the range of 50-70 g/m$^2$ could be studied in SCK paper specimens, wherein the fiber furnish was varied both as a function of the content of BSKP as well as a function of the content of the BCTMP.

The experimental setup contained several trial points TP1 to TP9, wherein the trial points were divided into three groups, based on whether the share of BSKP was less than 20 wt. %, equal to or higher than 20 wt. % or equal to or higher than 30 wt. %. In the first group, the content of BSKP was either 15 wt. % (TP7, TP8) or 18 wt. % (TP9). In the second group, the content of BSKP was 22.5 wt. % (TP4, TP5, TP6). In the third group the content of BSKP was 30 wt. % (TP1, TP2, TP3).

To obtain more information of the underlying dependencies, the number of data points in each trial point TP1 to TP9 was increased by producing SCK paper specimens in three different basis weight of 58, 62 and 68 g/m$^2$. Within each group, a trial point with higher BCTMP content was produced by increasing the share of BCTMP and reducing the share of BHKP, as indicated in table 1 (below). Hence, the addition of BCTMP was performed as a replacement such that the relative amount of BHKP in the fiber furnish was reduced.

TABLE 1

SCK paper specimen trial points TP1 to TP9 used in the experimental study. The weight percentages indicate the relative share of each pulp component in the fiber furnish.

| Trial point | BSKP (wt. %) | BHKP (wt. %) | BCTMP (wt. %) |
|---|---|---|---|
| TP1 | 30 | 65 | 5 |
| TP2 | 30 | 55 | 15 |
| TP3 | 30 | 45 | 25 |
| TP4 | 22.5 | 47.5 | 30 |
| TP5 | 22.5 | 42.5 | 35 |
| TP6 | 22.5 | 37.5 | 40 |
| TP7 | 15 | 40 | 45 |
| TP8 | 15 | 35 | 50 |
| TP9 | 18 | 72 | 10 |

SCK paper specimens for the trial points TP1 to TP9 used in the experimental study were prepared according to the ISO 5269-3 (2008) standard, using a conventional sheet-former method as described in ISO 5269-1 (2005), wherein a closed water system was used. The pulps were refined to levels typically used in SCK paper production. BCTMP refining was performed with a (Voith-Sulzer) laboratory refiner at 4% pulp consistency that corresponds well to mill refining and the °SR determined according to ISO 5267-1 (1999). The BCTMP was refined to a target °SR-value 45. The BSKP was refined to a target °SR 20-35 at a paper mill and the BHKP was refined to a target °SR 30-45 at a paper mill as well. After dewatering and drying the formed kraft paper specimens were conditioned overnight (relative humidity 90%, temperature +23° C.±2° C.). The kraft paper specimens were calendered in conditions of 100° C. roll temperature, 4000 dN pressure, using 2 passes, which produced specimens corresponding to industrial supercalendered kraft paper and having a target thickness typical for the respective basis weight.

Example 1—Comparison of Fiber Fractions and Average Dimensions

The fiber properties were analysed from the pulps used in the SCK paper specimens as well as from the fiber furnishes by means of Valmet Fiber Image Analyzer (Valmet FS5), which is an example of a device, which can be used according to the manufacturer's instructions to perform the fiber furnish analysis. A fiber furnish analysis is capable of identifying papermaking fibers from a sample. Another example of a fiber furnish analysis is the Graff "C" stain test according to ISO 9184-4:1990(en), in conjunction with ISO 9184-1 and, if necessary, ISO 9184-2, wherein the wood species used in a pulp may be distinguished by comparison method, wherein a sample fiber is compared against a known reference fiber.

Valmet Fiber Image Analyzer (Valmet FS5) may further be used for an analysis of fiber dimensions, such as fiber length and fiber width, as well as to quantify fiber fractions, such as mass of fractions and length weighted fiber length distributions of a sample, by means of automated optical analysis using unpolarized light, according to ISO 16065-2: 2014. The analysis is based on an ultra high resolution (UHD) camera system equipped with image analysis software, which is used to acquire a greyscale image of a sample, of which image the properties of the fibers in the sample may be determined. The greyscale image is acquired from a sample placed in a transparent sample holder, such as a cuvette, using a 0.5 millimetre depth of focus according to ISO 16505-2 standard.

The pulp types used in the study were characterised based on their fiber properties. Below are listed the pulp types and their abbreviation in the experimental study:

BSKP northern bleached softwood kraft pulp (*Picea, Pinus*)

BHKP bleached hardwood kraft pulp (*Betula*)

BCTMP bleached chemithermomechanical pulp (*Populus,* 75 wt. %) and spruce (*Picea,* 25 wt. %)

Reference is made to FIG. 1 and Table 2 (below), which show comparative data of the determined mass of fiber length fractions of BSKP, BHKP and BCTMP.

TABLE 2

Comparative data of mass of fiber length fractions according to fiber length in BSKP, BHKP and BCTMP.

| Fiber fraction | BSKP | BHKP | BCTMP |
|---|---|---|---|
| <0.2 mm (fines) | 7.4% | 8.7% | 22.1% |
| 0.2 < 0.6 mm | 6.5% | 12.6% | 24.5% |
| 0.6 < 1.2 mm | 11.2% | 58.2% | 39.4% |
| 1.2 < 2.0 mm | 20.7% | 19.1% | 11.9% |
| 2.0 < 3.2 mm | 37.9% | 1.4% | 1.7% |
| 3.2 < 7.6 mm | 16.2% | 0.1% | 0.4% |

The fiber mass fraction analysis was performed with Valmet Fiber Image Analyzer (Valmet FS5), using fiber length weighted distribution for classifying the fibers, according to the manufacturer's instructions and implementing ISO 16065-2: 2014, ISO 9184-4 and ISO 9184-1. In the analysis, fines were defined to be particles having a width over 10 micrometers and a length of less than 0.2 millimeters, and fibers were defined to be particles having a width in the range of 10 to 75 micrometers and a length above 0.2 millimeters.

As demonstrated by FIG. 1 and table 2 (above), the mass fraction distribution of BCTMP sample differs considerably from the mass fraction distributions of the two BKP samples. In the BCTMP sample, the mass of the shorter fiber fractions, up to 1.2 mm in length, forms 86% of the total mass, while in BSKP, the opposite is the case. In BSKP, close to 75% of the mass is in fractions having a length equal to or higher than 1.2·mm. In comparison, in BHKP, only 20,6% of the mass is in fractions having a length equal to or higher than 1.2. mm, while in BCTMP only 14% of the mass is in fractions having a length equal to or higher than 1.2. mm. Hence, most of the mass of BCTMP is in particles having a small average fiber length.

When analysing the number of fibers in each fraction, on the other hand, it was observed that most of the fiber distribution in the BCTMP were in the shortest fractions, whereas in BSKP, the distribution was much more even, as indicated by table 3 (below).

TABLE 3

Comparative data of number of fibers in a fraction according to fiber length in BSKP, BHKP and BCTMP.

| Fiber component | BSKP | BHKP | BCTMP |
|---|---|---|---|
| FS5 Fiber fractions (Fines) 0-0.2 mm % | 17.7% | 14.0% | 37.3% |
| FS5 Fiber fractions 0.2-0.6 mm % | 11.0% | 12.9% | 25.7% |
| FS5 Fiber fractions 0.6-1.2 mm % | 12.8% | 56.5% | 29.5% |
| FS5 Fiber fractions 1.2-2.0 mm % | 18.7% | 15.8% | 6.5% |
| FS5 Fiber fractions 2.0-3.2 mm % | 29.1% | 0.8% | 0.8% |
| FS5 Fiber fractions 3.2-7.6 mm % | 10.9% | 0.0% | 0.2% |

As an interim of the results above, the differences of the fiber analysis highlight that the origin of the pulp as well as the pulping method may be used to adjust the characteristics of the produced SCK paper.

Figure 2:
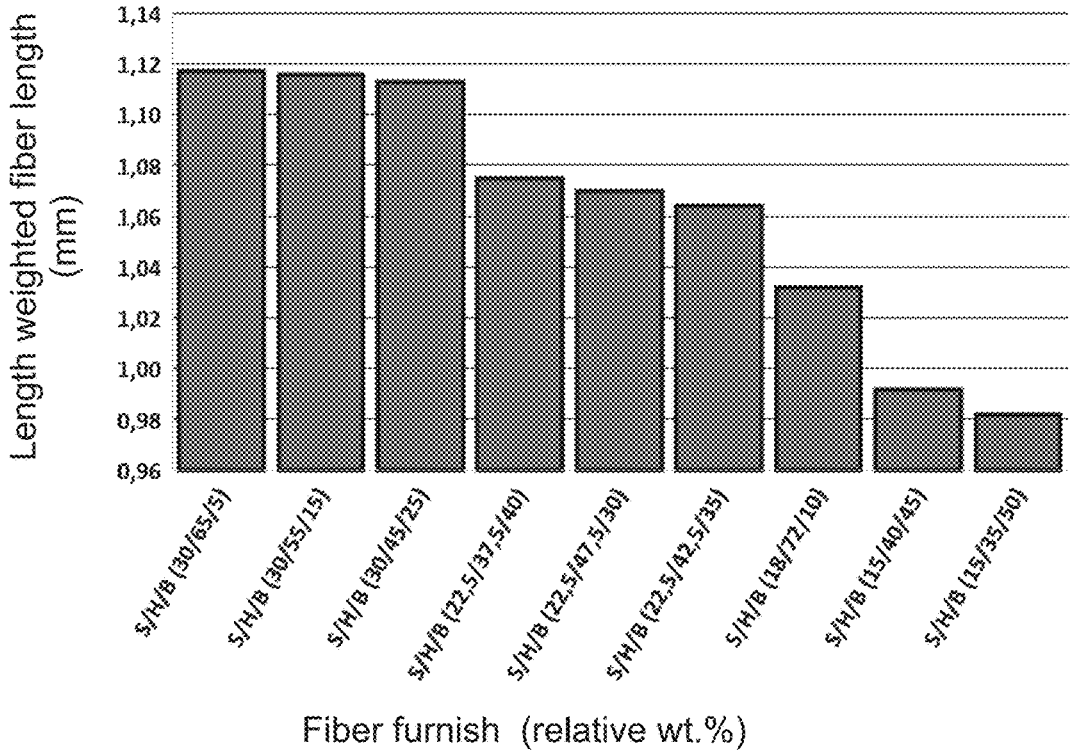
FIG. 2 is a diagram showing the effect of BSKP to average length weighted fiber length (mm) in SCK papers having different fiber furnishes.

Reference is made to FIG. 2 and to table 4 (below), which present the length weighted fiber length in millimeters determined form the SCK paper specimens (trial points TP1-TP9) in the experimental study. The diagram in FIG. 2 shows the advantageous effect of BSKP to the average fiber length in SCK paper. When the share of BSKP was 15 wt. %, the average length weighted fiber length of the fiber furnish was less than 1 mm. Further, when the SCK paper contained BSKP in an amount equal to or higher than 20 wt. %, when determined as dry matter content of the paper according to SCAN-P 39:80, an average length weighted fiber length equal to or higher than 1.03 mm is obtainable. Hence, when the share of BSKP was increased to be higher than 15 wt. %, such as equal to or higher than 20 wt. % or equal to or higher than 30 wt. %, the average length weighted fiber length of the fiber furnish increased significantly. A clear difference can be observed between the three groups in the trial. This was the case, since the increase was present within groups having a higher share of BSKP, regardless of the content of the BCTMP in the fiber furnish. The results therefore demonstrate a high dependency of the average fiber length to the content of BSKP in the fiber furnish, in SCK papers with low basis weight.

TABLE 4

Comparative data of the effect of BSKP to the average fiber length in SCK papers with low basis weight.

| Trial point | Fiber furnish | Length weighted fiber length (mm) |
|---|---|---|
| TP1 | S/H/B (30/65/5) | 1.12 |
| TP2 | S/H/B (30/55/15) | 1.12 |
| TP3 | S/H/B (30/45/25) | 1.11 |
| TP4 | S/H/B (22.5/47.5/30) | 1.07 |
| TP5 | S/H/B (22.5/42.5/35) | 1.06 |
| TP6 | S/H/B (22.5/37.5/40) | 1.08 |
| TP7 | S/H/B (15/40/45) | 0.99 |
| TP8 | S/H/B (15/35/50) | 0.98 |
| TP9 | S/H/B (18/72/10) | 1.03 |

Example 2—Effect of BCTMP Content to the Bulk in the SCK Paper Specimens

To evaluate the effect of BCTMP addition in SCK papers with low basis weight, the bulk of the produced uncalendered paper sheets, in each of the trial points TP1 to TP9, was determined. The results are presented in table 5 (below). The bulking thickness therein refers to the thickness of the uncalendered paper, determined as single sheet thickness according to ISO 534:2011. The apparent bulk density therein refers to the mass per unit volume of the uncalendered paper, which is expressed in kilograms per cubic meters (kg/m$^3$). The apparent bulk density has been calculated from a single sheet thickness according to ISO 534:2011. The bulk, as used therein, refers to the volume per unit mass, expressed in cubic centimeters per gram (cm$^3$/g). The bulk therefore represents the inverse of the paper density.

TABLE 5

Comparative data of the effect of BCTMP to the bulk of uncalendered SCK papers with low basis weight.

| Trial point | Fiber furnish | Basis weight (g/m$^2$) | Bulking thickness (μm) | Apparent bulk density (kg/m$^3$) | Bulk (cm$^3$/g) |
|---|---|---|---|---|---|
| TP1 | S/H/B (30/65/5) | 57.5 | 78 | 736 | 1.36 |
| | S/H/B (30/65/5) | 60.6 | 82 | 737 | 1.36 |
| | S/H/B (30/65/5) | 67.6 | 90 | 753 | 1.33 |
| TP2 | S/H/B (30/55/15) | 58.2 | 80 | 724 | 1.38 |
| | S/H/B (30/55/15) | 62.0 | 85 | 726 | 1.38 |
| | S/H/B (30/55/15) | 68.3 | 94 | 730 | 1.37 |
| TP3 | S/H/B (30/45/25) | 58.7 | 84 | 699 | 1.43 |
| | S/H/B (30/45/25) | 62.0 | 87 | 709 | 1.41 |
| | S/H/B (30/45/25) | 68.1 | 95 | 714 | 1.40 |
| TP4 | S/H/B (22.5/47.5/30) | 58.6 | 86 | 683 | 1.46 |
| | S/H/B (22.5/47.5/30) | 62.4 | 90 | 697 | 1.44 |
| | S/H/B (22.5/47.5/30) | 68.0 | 96 | 711 | 1.41 |
| TP5 | S/H/B (22.5/42.5/35) | 57.7 | 86 | 675 | 1.48 |
| | S/H/B (22.5/42.5/35) | 62.0 | 91 | 684 | 1.46 |
| | S/H/B (22.5/42.5/35) | 68.1 | 99 | 685 | 1.46 |
| TP6 | S/H/B (22.5/37.5/40) | 58.6 | 88 | 666 | 1.50 |
| | S/H/B (22.5/37.5/40) | 62.1 | 93 | 668 | 1.50 |
| | S/H/B (22.5/37.5/40) | 68.4 | 101 | 679 | 1.47 |
| TP7 | S/H/B (15/40/45) | 58.3 | 89 | 652 | 1.53 |
| | S/H/B (15/40/45) | 62.3 | 95 | 655 | 1.53 |
| | S/H/B (15/40/45) | 68.1 | 102 | 668 | 1.50 |
| TP8 | S/H/B (15/35/50) | 58.3 | 91 | 644 | 1.55 |
| | S/H/B (15/35/50) | 62.2 | 95 | 653 | 1.53 |
| | S/H/B (15/35/50) | 68.3 | 104 | 657 | 1.52 |
| TP9 | S/H/B (18/72/10) | 58.2 | 82 | 714 | 1.40 |
| | S/H/B (18/72/10) | 62.0 | 85 | 728 | 1.37 |
| | S/H/B (18/72/10) | 67.5 | 92 | 735 | 1.36 |

The results demonstrate that the bulking thickness may be adjusted significantly as a function of the BCTMP content in the fiber furnish. The results also evidence that SCK papers with low basis weight, particularly in the range of 50-70 g/m$^2$, are exceptionally suitable for the adjustment of density with BCTMP. This was observed throughout the studied range of 5 to 50 wt. % of 10 BCTMP additions to the fiber furnish, determined as dry matter content of the paper (SCAN P 39:80). Thus, a considerable increase of bulk was obtainable. The obtained increase in the bulk enabled supercalendering of the paper sheets into the same thickness as corresponding SCK papers, which contain only BHKP and softwood, while maintaining a lower density than in the corresponding SCK papers, due to the obtained increase of bulk.

Example 3—Comparison of Water Retention Value in the in SCK Paper Specimens

The SCK paper specimens in trial points TP1 to TP9 were also characterized in respect of their water retention value, abbreviated as WRV, according to ISO 23714:2014(en). WRV is an empirical measure of the capacity of a pulp sample to hold water. The WRV was determined as an average of two parallel samples, each sample amount consisting of 1 g of dry pulp diluted into 500 ml of water and having a temperature of 23±3° C. Materials and methods as listed below were used:

Beckman Coulter Avanti J-301 laboratory centrifuge
Centrifugal force of 3000 g±50 g, 30 minutes
JS 7,5 rotor (speed 5350; RPM 5289)

The sample was weighed first time after the centrifugation. The sample was then dried overnight (12 h) at 105±2° C. and cooled down to a room temperature of 23±3° C. in an excicator. The sample was then weighed a second time. A laboratory scale (0.0001 g precision) was used for the weighing.

The water retention value was calculated according to equation 1 below:

$$WRV = \frac{m1}{m2} - 1 \qquad \text{Equation 1}$$

wherein $m^1$=mass of sample after centrifugation, in grams $m^2$=mass of sample after drying, in grams.

The results in table 6 (below) indicate that when the share of BSKP in the pulp mixture is reduced to 15 wt. % of the fiber furnish, while keeping the share of BCTMP high, a drop in the WRV is perceived. Hence, upon manufacturing SCK paper for a release liner, a minimum amount of BSKP equal to or higher than 15 wt. % should be used, to prevent fluctuation of the WRV level. Further, when the amount of BSKP in the fiber furnish is above the minimum amount, the amount BCTMP content may be varied significantly, in the range of 5 to 50 wt. %, without corresponding alteration in the capacity of the pulp mixture to hold water. Thus, when producing SCK paper, an optimum range exists, wherein the amount of BSKP may be arranged to interact with the amount of BCTMP in the fiber furnish. When studying the WRV of the unmixed pulps used for the fiber furnish, it was observed that WRV of the BSKP was the highest, 1.84 g/g. The WRV of BHKP was 1.60 g/g, which was on a comparable level with the BCTMP, having a WRV of 1.58 g/g.

TABLE 6

Comparative data of water retention values in SCK paper specimens of the experimental study, wherein the relative share of BSKP, BHKP and BCTMP was varied.

| Sample | Fiber furnish | WRV (g/g) |
|---|---|---|
| TP1 | S/H/B (30/65/5) | 1.65 |
| TP2 | S/H/B (30/55/15) | 1.69 |
| TP3 | S/H/B (30/45/25) | 1.66 |
| TP4 | S/H/B (22.5/47.5/30) | 1.65 |
| TP5 | S/H/B (22.5/42.5/35) | 1.67 |
| TP6 | S/H/B (22.5/37.5/40) | 1.67 |
| TP7 | S/H/B (15/40/45) | 1.63 |
| TP8 | S/H/B (15/35/50) | 1.62 |
| TP9 | S/H/B (18/72/10) | 1.67 |

Example 4—Effect of BCTMP and BSKP Combination for SCK Paper Quality Criteria To study the combined effect of BSKP and BCTMP in the fiber furnish in respect of the quality specifications for SCK papers, the uncalendered papers, as disclosed above, were supercalendered, using target thicknesses in the range of 51 to 61 micrometers, which are typical for SCK papers in the range of 58 to 68 g/m$^2$. Paper specimens having a basis weight of 58 g/m$^2$ were supercalendered into a thickness in the range of 51 to 53 micrometers. Paper specimens having a basis weight of 62 g/m$^2$ were supercalendered into a thickness in the range of 52 to 56 micrometers. Paper specimens having a basis weight of 68 g/m$^2$ were supercalendered into a thickness in the range of 57 to 61 micrometers. The average density of the prepared supercalendered kraft paper specimens was 1127±17 kg/m$^3$, the latter number indicating the standard deviation.

Tensile, bending and tear strength properties, as well as optical properties of the prepared SCK paper specimens were determined to evaluate the suitability of the produced SCK paper for use as a substrate layer of an industrial release liner. Tensile index refers to the tensile strength divided by the basis weight, determinable according to standard ISO 1924-3:2005(en), in units of Newton meter per gram. Tensile index is indicative of the strength of the paper derived from factors such as fiber strength, fiber length, and bonding. It can also be used as an indication of the potential of a paper substrate to resist web breaking during a labelling operation. Bending stiffness refers to the potential of a paper to resist bending caused by a given applied force and is determinable according to standard ISO 5628:2019(en), in units of milliNewton meters (mNm). Bending stiffness has been observed to be also indicative of the compressibility of the paper and may thus be used to assess the potential of a paper to resist compression, for instance upon a die-cutting operation, if the paper is used as a substrate layer of a release liner for adhesive labels. Tear index refers to the tearing strength of a paper divided by its basis weight, determinable according to ISO 1974, and is expressed in units of milliNewtons divided by grams per square meters (mNm$^2$/g). Tear index is indicative of the resistance of a paper to a tearing force that it is subjected to, which is a quality characteristic for a paper used as a substrate layer of an industrial release liner. It can be measured in machine direction (MD) or cross direction (CD) of a paper, the machine direction referring to the travelling direction of the paper on a paper machine. Table 7 (below) indicates the results of the strength and optical properties determined from the prepared supercalendered kraft paper specimens.

TABLE 7

Results concerning the density, strength and optical properties of the prepared SCK paper specimens in trial points TP1 to TP9. In each trial point, paper specimens were produced into three different basis weight of 58, 62 and 68 g/m$^2$. When considered together, the value ranges determined from the SCK paper specimens for density, tensile index, bending stiffness, tear index, as well as transparency indicate suitability for use as a substrate layer of a release liner.

| Trial point | Fiber furnish | basis weight (g/m$^2$) | density (kg/m$^3$) | Tensile index (Nm/g) | Bending stiffness (mNm) | Tear index (mNm$^2$/g) | Transp. (%) |
|---|---|---|---|---|---|---|---|
| TP1 | S/H/B (30/65/5) | 58 | 1142 | 84 | 1.0 | 6.4 | 52 |
| | S/H/B (30/65/5) | 62 | 1151 | 82 | 1.1 | 6.7 | 51 |
| | S/H/B (30/65/5) | 68 | 1165 | 79 | 1.5 | 7.0 | 49 |
| TP2 | S/H/B (30/55/15) | 58 | 1136 | 76 | 0.9 | 6.3 | 51 |
| | S/H/B (30/55/15) | 62 | 1137 | 77 | 1.2 | 6.7 | 49 |
| | S/H/B (30/55/15) | 68 | 1146 | 79 | 1.5 | 6.8 | 48 |
| TP3 | S/H/B (30/45/25) | 58 | 1128 | 72 | 0.9 | 6.1 | 50 |
| | S/H/B (30/45/25) | 62 | 1134 | 72 | 1.1 | 6.3 | 50 |
| | S/H/B (30/45/25) | 68 | 1141 | 75 | 1.4 | 6.5 | 49 |
| TP4 | S/H/B (22.5/47.5/30) | 58 | 1134 | 72 | 1.0 | 6.2 | 49 |
| | S/H/B (22.5/47.5/30) | 62 | 1134 | 71 | 1.2 | 6.1 | 49 |
| | S/H/B (22.5/47.5/30) | 68 | 1144 | 69 | 1.5 | 6.3 | 48 |
| TP5 | S/H/B (22.5/42.5/35) | 58 | 1112 | 68 | 1.0 | 5.6 | 51 |
| | S/H/B (22.5/42.5/35) | 62 | 1112 | 70 | 1.2 | 5.9 | 48 |
| | S/H/B (22.5/42.5/35) | 68 | 1116 | 69 | 1.5 | 6.0 | 47 |
| TP6 | S/H/B (22.5/37.5/40) | 58 | 1097 | 65 | 1.0 | 5.7 | 48 |
| | S/H/B (22.5/37.5/40) | 62 | 1112 | 69 | 1.2 | 5.6 | 50 |
| | S/H/B (22.5/37.5/40) | 68 | 1126 | 67 | 1.4 | 5.9 | 47 |
| TP7 | S/H/B (15/40/45) | 58 | 1099 | 62 | 1.0 | 5.4 | 47 |
| | S/H/B (15/40/45) | 62 | 1111 | 66 | 1.2 | 5.6 | 46 |
| | S/H/B (15/40/45) | 68 | 1114 | 66 | 1.5 | 5.9 | 45 |
| TP8 | S/H/B (15/35/50) | 58 | 1105 | 63 | 1.0 | 5.3 | 48 |
| | S/H/B (15/35/50) | 62 | 1108 | 62 | 1.1 | 5.4 | 47 |
| | S/H/B (15/35/50) | 68 | 1116 | 62 | 1.5 | 5.5 | 46 |
| TP9 | S/H/B (18/72/10) | 58 | 1131 | 75 | 0.9 | 6.3 | 51 |
| | S/H/B (18/72/10) | 62 | 1145 | 76 | 1.2 | 6.5 | 50 |
| | S/H/B (18/72/10) | 68 | 1146 | 79 | 1.4 | 6.6 | 49 |

When reviewing the results of table 7 above, moderate decrease can be seen in the tensile index and tear index levels in the trial points TP1 to TP9, as the amount of BCTMP in the fiber furnish is increased. However, even when the amount of BHKP in the fiber furnish was reduced significantly by means of BCTMP replacement from 72 wt. % in TP9 to 35 wt. % in TP8, a paper having sufficient strength characteristics for a substrate layer of a release liner could still be obtained, presenting a tear index higher than 5 $mNm^2/g$ and a tensile index higher than 60 Nm/g. A relatively high and sufficient transparency could also be obtained, regardless of the basis weight produced, at a desired target thickness level, which enables the use of optical sensors to measure brightness variation. In particular, as indicated by the results above, the bending stiffness was also maintained and even slightly increases as a function of BCTMP content in the fiber furnish, when the SCK paper contains BCTMP in an amount in the range of 5 to 50 wt. % and BSKP in an amount equal to or higher than 15 wt. %, when determined as dry matter content of the paper according to SCAN P 39:80. Thus, the substitution of BHKP with BCTMP enables to maintain incompressibility of the SCK paper. The results indicate that a tailored fiber furnish, wherein the amount of BCTMP and BSKP have been optimized, may be arranged to provide SCK paper with both lower density, relatively high transparency and potential to resist compression, which facilitates an even die strike pattern during a die-cutting operation—while maintaining the tear index and tensile strength at a sufficient level for use as a substrate layer for a release liner.

Figure 3:
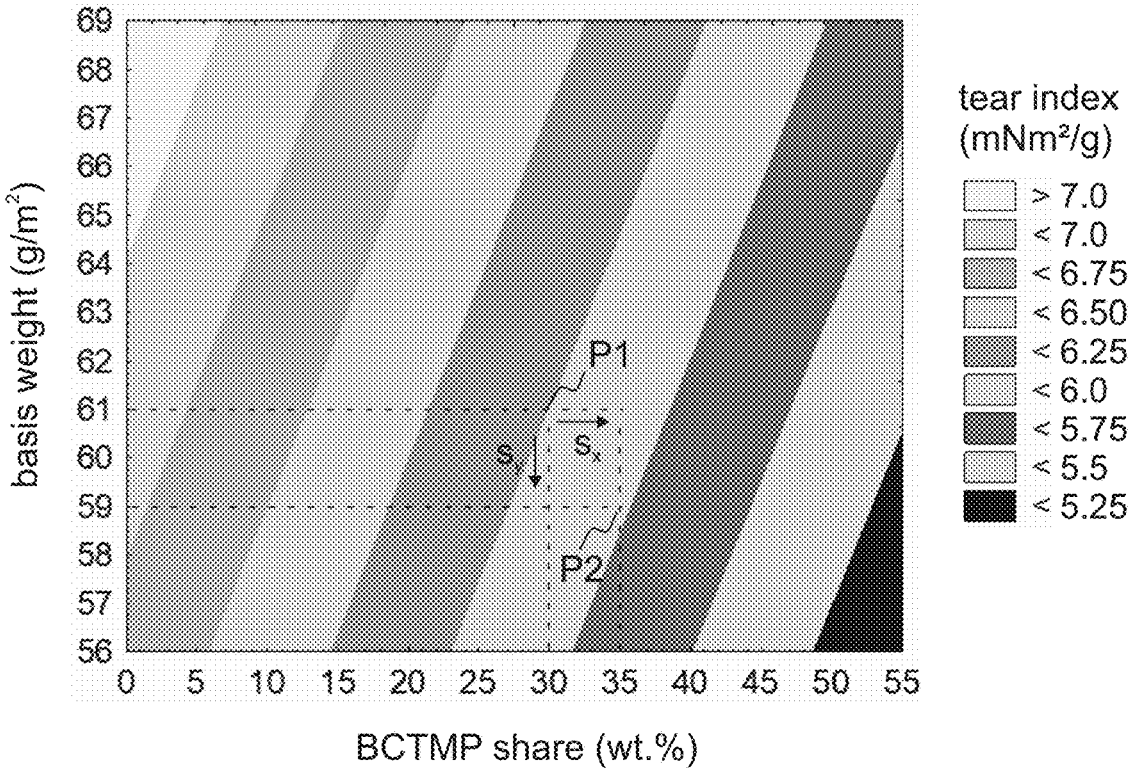
FIG. 3 is a multivariable diagram showing how tear index (mNm$^2$/g) and basis weight (g/m$^2$) correlate in SCK papers as a function of the BCTMP share (wt. %), determined as dry matter content of the paper according to SCAN-P 39:80.
Figure 4:
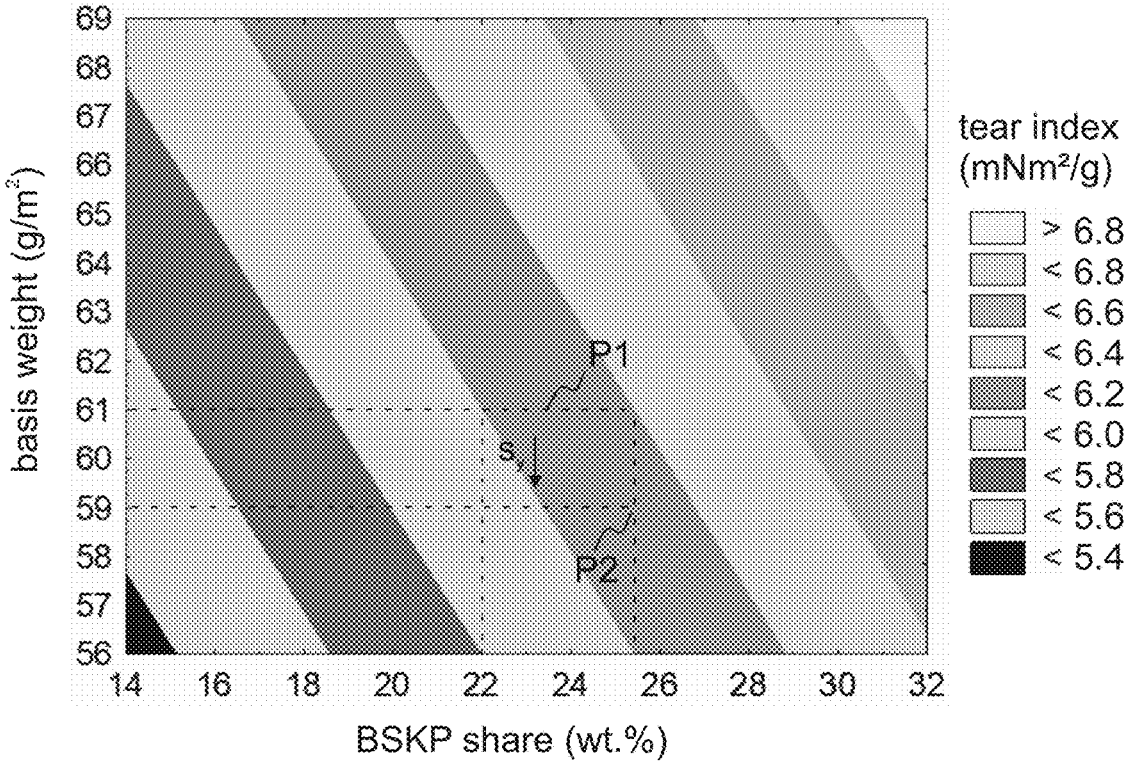
FIG. 4 is a multivariable diagram showing how tear index (mNm$^2$/g) and basis weight (g/m$^2$) correlate in SCK papers as a function of the BSKP share (wt. %), determined as dry matter content of the paper according to SCAN-P 39:80.
Figure 5:
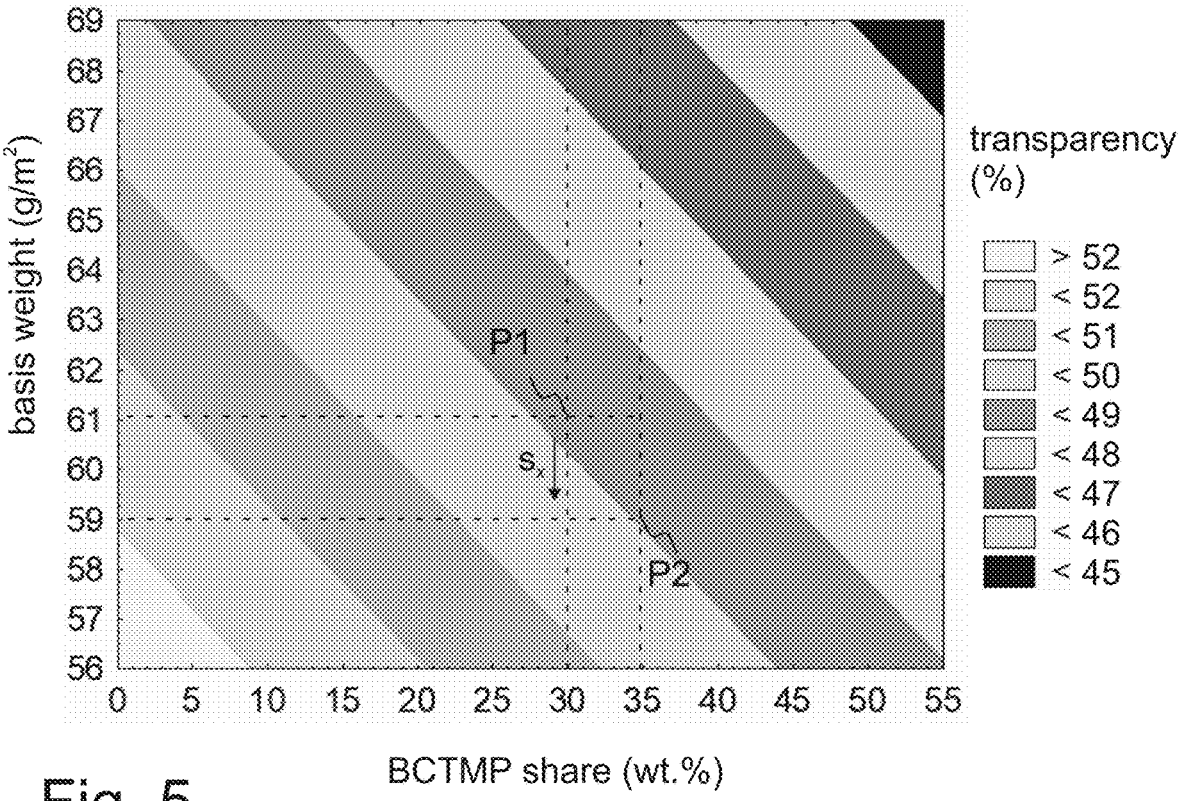
FIG. 5 is a multivariable diagram showing how transparency (%) and basis weight (g/m$^2$) correlate in SCK papers as a function of the BCTMP share (wt. %), determined as dry matter content of the paper according to SCAN-P 39:80.

The dependency of basis weight, fiber furnish composition and paper characteristics of each other was further studied by means of multivariable optimization, as illustrated by FIGS. 3 to 5. The figures illustrate, when viewed together, by way of the examples, how mechanical and optical properties of the produced SCK paper are maintained, when the basis weight of the paper is shifted and/or when the composition of the fiber furnish is altered by adjusting the amount of BCTMP and/or BSKP in the fiber furnish—while maintaining the target thickness of the SCK paper. The symbols P1 and P2 in the figures illustrate SCK papers having the same target thickness, but a different basis weight and, subsequently, different densities.

Reference is made to FIG. 3, which is a multivariable diagram based on the experimental results, and which illustrates how basis weight correlates with the tear index, as a function of BCTMP content in a SCK paper having a defined target thickness, as disclosed below. The vertical axis represents the basis weight ($g/m^2$) of the SCK paper, determined according to ISO 536. The horizontal axis represents the amount of BCTMP (wt. %) in the fiber furnish, determined as dry matter content of the paper according to SCAN P 39:80. The shading of the inclined bars in the diagram represents the range of tear index ($mNm^2/g$), determined according to ISO 1974. The inclination angle of the bars in the diagram is indicative of the direction of change of the tear index. When moving from top left corner towards the bottom right corner in the diagram, the tear index decreases.

Reference is further made to FIG. 4, which is a multivariable diagram based on the experimental results, and which illustrates how basis weight correlates with the tear index, as a function of BSKP content in a SCK paper having the same defined target thickness, as disclosed below. The vertical axis represents the basis weight ($g/m^2$) of the SCK paper, determined according to ISO 536. The horizontal axis represents the amount of BSKP (wt. %) in the fiber furnish, determined as dry matter content of the paper according to SCAN P 39:80. The shading of the inclined bars in the diagram represents the range of tear index ($mNm^2/g$), determined according to ISO 1974. The inclination angle of the bars in the diagram is indicative of the direction of change of the tear index. When moving from bottom left corner towards the top right corner in the diagram, the tear index increases.

Reference is further made to FIG. 5, which is a multivariable diagram based on the experimental results, and which illustrates how basis weight correlates with the transparency, as a function of BCTMP content in a SCK paper having the same defined target thickness, as disclosed below. The vertical axis represents the basis weight ($g/m^2$) of the SCK paper, determined according to ISO 536. The horizontal axis represents the amount of BCTMP (wt. %) in the fiber furnish, determined as dry matter content of the paper according to SCAN P 39:80. The shading of the inclined bars in the diagram represents the transparency range (%), determined according to ISO 2469. The inclination angle of the bars in the diagram is indicative of the direction of change of the transparency. When moving from bottom left corner towards the top right corner in the diagram, the transparency decreases.

FIGS. 3 and 4, when viewed together, demonstrate the interdependency of the shares of BCTMP and BSKP in the fiber furnish to the tear index of the SCK paper. This is illustrated by a situation, wherein the basis weight is shifted by 2 $g/m^2$ in a direction sy by means of adjusting the share of BCTMP in the fiber furnish by 5 wt. % in a direction sx, as indicated in FIG. 3 with the dashed lines. Paper P1 represents a SCK paper having a basis weight of 61 $g/m^2$ and a target thickness of 53.5 micrometers, thus having a density of 1140 $kg/m^3$. Paper P2 represents a SCK paper having a basis weight of 59 $g/m^2$ and the same target thickness of 53.5 micrometers, thus having a density of ca. 1100 $kg/m^3$. When the basis weight is decreased by 2 $g/m^2$, while maintaining the same target thickness, the density of the SCK paper P2 is subsequently reduced close to 40 $kg/m^3$, in comparison to the heavier SCK paper P1. Multivariable diagrams, such as presented by FIGS. 3 and 4, provide a tool that enables to evaluate the effect of this shift of basis weight, which has been achieved due to the change in the amount of BCTMP, in light of other parameters, such as the tear index of the SCK paper. For instance, the diagrams in FIGS. 3 and 4 indicate, that a relative change of 5 wt. % of BCTMP from 30 to 35 wt. % (indicated by distance between the vertical dashed lines in FIG. 3) may be performed while maintaining a tear index equal to or higher than 6 $mNm^2/g$ (indicated by the shade of the inclined bar in FIGS. 3 and 4), when the share of BSKP in the fiber furnish is maintained sufficiently high, such as at least 22 wt. % (leftmost vertical dashed line in FIG. 4). The breadth and inclination angle of the shaded bar in FIG. 4 suggest of the potential of the BSKP to preserve the tear index, when replacing BHKP with BCTMP. When shifting from the basis weight of the SCK paper P1 to the basis weight of the SCK paper P2, a BSKP share in the range of 22 to 25.5 wt. % may be used, if a tear index in the range of 6 to 6.4 $mNm^2/g$ should be achieved. Further information may be retrieved from other multivariable diagrams, such as FIG. 5, which is indicative of the effect of the same shift of basis weight to the transparency of the SCK paper. FIG. 5 also illustrates that when a relative change of 5 wt. % of BCTMP from 30 to 35 wt. % is performed to the fiber furnish, while maintaining the same target thickness by supercalendering, the fiber furnish combination enables the transparency to be maintained in a relatively high level in the range of 47 to 51% (the shades covered between the vertical dashed lines in FIG. 5). On the other hand, when the basis weight is decreased by 2 g/m$^2$ (the horizontal dashed lines in FIG. 5), while maintaining other variables unchanged, a relatively small decrease to transparency may occur, the transparency still being in the range of 48 to 50% (indicated by the shades covered between the horizontal and vertical dashed lines in FIG. 5).

Thus, referring to the above, the experimental results indicate the pliability of the SCK paper in a basis weight range of 50-70 g/m$^2$, when the underlying properties of the different type of pulps, BSKP and BCTMP in particular, are used together optimally. This enables a fiber furnish containing BCTMP in the range of 5 to 50 wt. %, when determined as dry matter content of the paper according to SCAN P 39:80, which may be supercalendered into the same thickness as a similar kraft paper with a higher basis weight, while maintaining a transparency level of at least 40%, such as in the range of 40 to 56%. Thus a significant reduction of the basis weight is obtainable, while maintaining a predefined thickness specification and without other relevant quality characteristics falling out of the SCK paper specifications.

Figure 6:
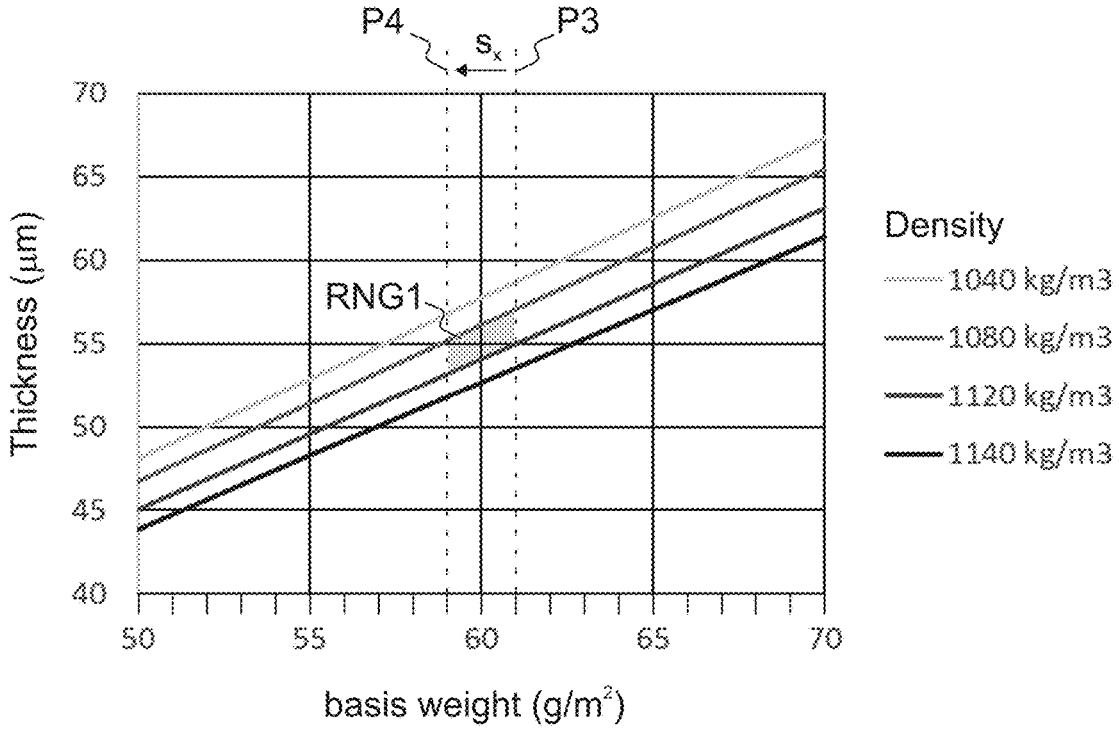
FIG. 6 is a diagram that illustrates how the characteristics of SCK paper having a basis weight in the range of 50 to 70 g/m$^2$ provide an optimization range RNG1, wherein the basis weight of the paper to be produced may be adjusted by means of a fiber furnish composition, while maintaining the target thickness and without inducing adverse effects to other paper properties, which would prevent its use as substrate layer of an industrial release liner for adhesive labels.

Reference is further made to FIG. 6, which illustrates how the characteristics of SCK paper having a basis weight in the range of 50 to 70 g/m$^2$ provide an optimization range RNG1, wherein the basis weight of the SCK paper to be produced may be adjusted by means of fiber furnish composition as disclosed above. The vertical axis represents the thickness in micrometers (μm) of the SCK paper, determined as single sheet thickness of a paper according to ISO 534:2011. The horizontal axis represents the basis weight in grams per square meters (g/m$^2$) of the SCK paper, determined according to ISO 536. The parallel diagonal lines in the diagram represents different density levels of the SCK paper, the density levels expressed in kilograms per cubic meter (kg/m$^3$). The angle of inclination of the lines in the diagram is indicative of the typical correlation strength between basis weight and thickness in industrial SCK papers in the range of 50 to 70 g/m$^2$. When moving along a diagonal lines from bottom left corner towards the top right corner in the diagram, the density remains the same, while the basis weight and the thickness increase.

In FIG. 6, paper P3 represents SCK paper having a basis weight of 61 g/m$^2$ and a target thickness of 55 micrometers, thus having a density of 1120 kg/m$^3$. Paper P4 represents SCK paper having a basis weight of 59 g/m$^2$ and the same target thickness of 55 micrometers, thus having a density of 1080 kg/m$^3$. The shaded area represents an optimization range RNG1, wherein the multivariable diagrams discussed above need to be accounted for.

Hence, when starting from SCK paper P3 and desiring a reduction of 2 g/m$^2$ of the basis weight (the distance between the vertical dashed lines indicated in FIG. 6), the multivariable diagrams provide a tool for evaluating the means for obtaining a SCK paper P4 having the same thickness and sufficient quality for the intended purpose (as illustrated by FIGS. 3 to 5). To maintain the sufficient quality, the amount of BCTMP in the fiber furnish needs to be considered in light of the amount of BSKP in the fiber furnish.

The invention disclosed above has been described with the aid of illustrations and examples. The methods or any product obtained by the methods are not limited solely to the above presented examples, but may be modified within the scope of the appended claims.

The invention claimed is:

1. A supercalendered kraft paper suitable for use as a substrate layer of an industrial release liner for adhesive labels, the supercalendered kraft paper comprising
- a basis weight in the range of 50 to 70 g/m$^2$, when determined according to ISO 536, and
- a fiber furnish determinable with standard ISO 9184-4 in conjunction with standard ISO 9184-1, the fiber furnish comprising
  - bleached hardwood kraft pulp,
  - bleached softwood kraft pulp and
  - bleached chemithermomechanical pulp,
  - wherein the fiber furnish has an average length weighted fiber length in the range of 0.90 to 1.14 mm, when determined according to ISO 16065-2: 2014,
- such that the supercalendered kraft paper contains
  - the bleached chemithermomechanical pulp in an amount equal to or higher than 5 wt. % and the bleached softwood kraft pulp in an amount equal to or higher than 15 wt. %, when determined as dry matter content of the paper according to SCAN-P 39:80,
- the supercalendered kraft paper thereby having
  - a tear index in the cross direction of the paper higher than 5 mNm$^2$/g, when determined according to ISO 1974,
  - a transparency level equal to or higher than 40%, when determined according to ISO 2469 and
  - a density in the range of 1040 to 1140 kg/m$^3$, when determined according to ISO 534.

2. The paper according to claim 1, wherein the fiber furnish has an average fiber width in the range of 22 to 25 micrometers, when determined according to ISO 16065-2: 2014.

3. The paper according to claim 1, wherein the supercalendered kraft paper contains the bleached softwood kraft pulp in an amount in the range of 15 to 65 wt. %, when determined as dry matter content of the paper according to SCAN-P 39:80.

4. The paper according to claim 1, wherein the supercalendered kraft paper contains the bleached chemithermomechanical pulp in an amount in the range of 5 to 50 wt. %, when determined as dry matter content of the paper according to SCAN-P 39:80.

5. The paper according to claim 1, the bleached chemithermomechanical pulp comprising fibers from softwood, the softwood being a coniferous tree.

6. The paper according to claim 1, the bleached chemithermomechanical pulp comprising fibers from hardwood, the hardwood being a broadleaved tree.

7. The paper according to claim 1, wherein the share of softwood fibers in the bleached chemithermomechanical pulp is in the range 10 to 60 wt. %, when determined as dry matter content of the bleached chemithermomechanical pulp according to SCAN-P 39:80.

8. The paper according to claim 1, wherein the basis weight of the paper is in the range of 52 to 68 g/m$^2$, when determined according to ISO 536.

9. The paper according to claim 1, wherein the supercalendered kraft paper has a transparency in the range of 40 to 56%, when determined according ISO 2469.

10. The paper according to claim 1, the supercalendered kraft paper comprising CIE L*, a*, b* colour space coordinate values, wherein
- L* is in the range of 92 to 98,
- a* is in the range of −4 to +2, and
- b* is in the range of +5 to +11, when determined by means of diffuse reflectance method with the elimination of specular gloss, using 2° standard observer, in accordance with ISO 5631-1:2015(en).

11. The paper according to claim 1, wherein the supercalendered kraft paper has a density in the range of 1040 to 1120 kg/m$^3$, when determined according to ISO 534.

12. The paper according to claim 1, wherein the fiber furnish of the supercalendered kraft paper has a water retention value in the range of 1.50 to 1.90 g/g, when determined according to ISO 23714:2014 from a sample having a dry matter content of 1 gram.

13. The paper according to claim 1, the fiber furnish comprising bleached hardwood kraft pulp in an amount equal to or less than 35 wt. %, bleached softwood kraft pulp in an amount equal to or higher than 15 wt. % and bleached chemithermomechanical pulp in an amount equal to or higher than 35 wt. %, when determined as dry matter content of the paper according to SCAN-P 39:80.

14. A release liner comprising a substrate layer and a release coating, wherein the substrate layer is a supercalendered kraft paper according to claim 1, which comprises a primer coating applied on at least one side of the supercalendered kraft paper.

15. A method of manufacturing supercalendered kraft paper suitable for use as a substrate layer of an industrial release liner for adhesive labels, the method comprising mixing together bleached hardwood kraft pulp, bleached softwood kraft pulp, and bleached chemithermomechanical pulp, wherein the fiber furnish has an average length weighted fiber length in the range of 0.90 to 1.14 mm, when determined according to ISO 16065-2: 2014, such that a pulp mixture is obtained, which has a fiber furnish determinable with standard ISO 9184-4 in conjunction with the standard ISO 9184-1, forming a paper web from the pulp mixture on a paper machine, reducing moisture content of the paper web in a press section, drying the paper web in a drying section, thereby forming paper, and calendering the paper, such that a supercalendered kraft paper is obtained having a basis weight in the range of 50 to 70 g/m$^2$, and which contains the bleached chemithermomechanical pulp in an amount equal to or higher than 5 wt. % and the bleached softwood kraft pulp in an amount equal to or higher than 15 wt. %, when determined as dry matter content of the paper according to SCAN P 39:80, the supercalendered kraft paper thereby having a tear index in the cross direction of the paper higher than 5 mNm$^2$/g, when determined according to ISO 1974, a transparency level equal to or higher than 40%, when determined according to ISO 2469 and a density in the range of 1040 to 1140 kg/m$^3$, when determined according to ISO 534.

16. The method according to claim 15, wherein upon mixing, the bleached chemithermomechanical pulp has a Schopper-Riegler number in the range of 25 to 55, when determined according to ISO 5267-1.

* * * * *